US007840173B2

(12) United States Patent
Kougami et al.

(10) Patent No.: US 7,840,173 B2
(45) Date of Patent: Nov. 23, 2010

(54) SHEET MOISTURIZING DEVICE, SHEET REMEDYING APPARATUS INCORPORATING THE SHEET MOISTURIZING DEVICE, AND IMAGE FORMING APPARATUS INCORPORATING THE SHEET MOISTURIZING DEVICE

(75) Inventors: Masashi Kougami, Saitama (JP); Toshio Shida, Higashiyamato (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 565 days.

(21) Appl. No.: 11/899,788

(22) Filed: Sep. 7, 2007

(65) Prior Publication Data

US 2008/0089728 A1 Apr. 17, 2008

(30) Foreign Application Priority Data

Oct. 13, 2006 (JP) ..... 2006-279948

(51) Int. Cl.
*G03G 15/00* (2006.01)

(52) U.S. Cl. ..... 399/406; 399/407

(58) Field of Classification Search ..... 399/406
See application file for complete search history.

(56) References Cited

U.S. PATENT DOCUMENTS 4,464,035 A * 8/1984 Schoering ..... 396/577
4,690,055 A * 9/1987 Fadner et al. ..... 101/451
4,864,925 A * 9/1989 Van Kanegan et al. ..... 101/141
5,205,216 A * 4/1993 Okamura et al. ..... 101/367
5,404,818 A * 4/1995 Odom ..... 101/366
5,987,301 A 11/1999 Acquaviva
6,052,553 A * 4/2000 Acquaviva et al. ..... 399/406
7,664,422 B2 * 2/2010 Shida et al. ..... 399/97
2006/0269311 A1 11/2006 Yamauchi et al.

FOREIGN PATENT DOCUMENTS

JP 11-249319 A 9/1999
JP 2002-287603 A 10/2002
JP 2006-008282 A 1/2006

OTHER PUBLICATIONS

Japanese Office Action dated Aug. 26, 2008 and English translation thereof issued in counterpart Japanese Appln. No. 2006-279948.

* cited by examiner

*Primary Examiner*—Anthony H. Nguyen
(74) *Attorney, Agent, or Firm*—Holtz, Holtz, Goodman & Chick, PC

(57) ABSTRACT

A sheet moisturizing device, including: paired moisturizing rollers which form a nipping section to apply water onto a sheet when the sheet is conveyed through the nipping section; two water supplying rollers, each being in pressure contact to each of paired moisturizing rollers respectively; and two water supplying tanks, each arranged to face one of the water supplying rollers, wherein each of the two water supplying tanks is structured of a first tank which supplies water to the water supplying roller, and a second tank which is formed around the first tank and accommodates the water overflowed from the first tank.

7 Claims, 8 Drawing Sheets

FIG. 6 (a) PRIOR ART
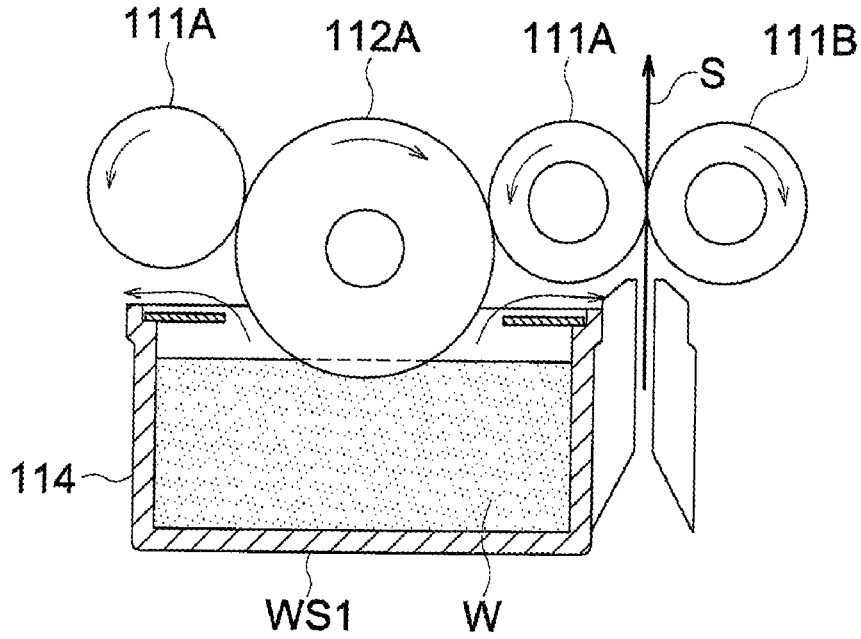
FIG. 6 (b)
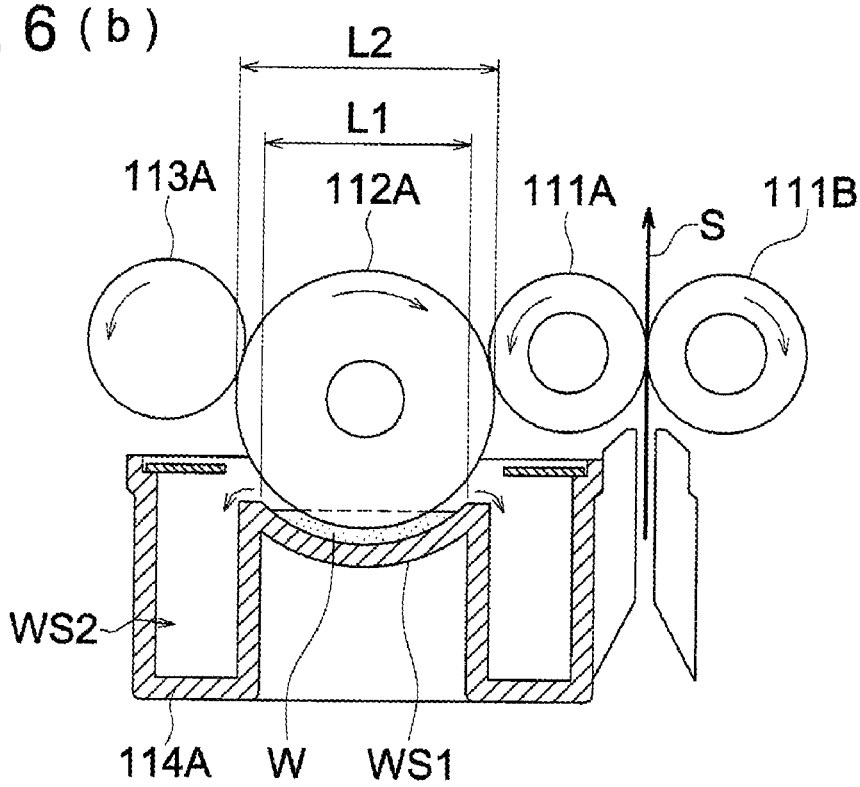

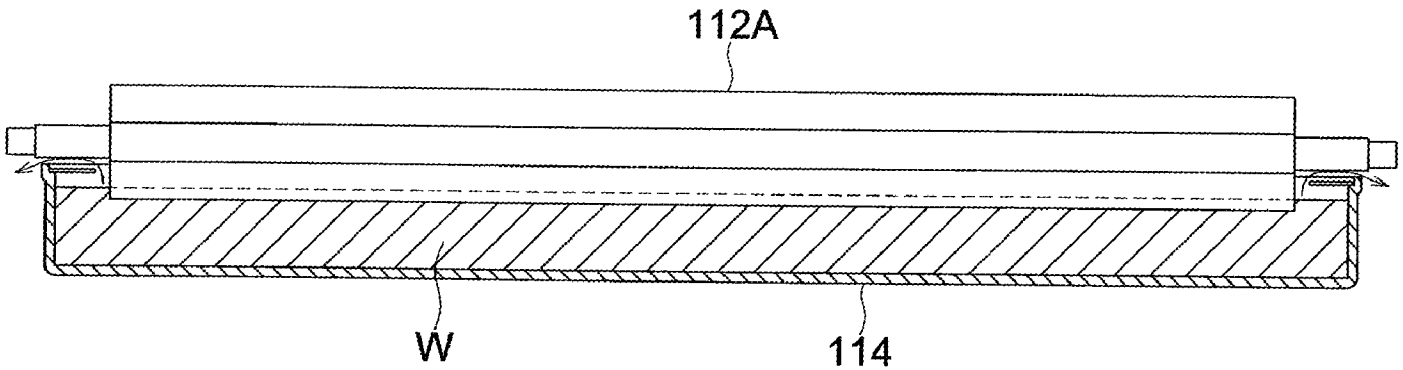
FIG. 7 ( a ) PRIOR ART
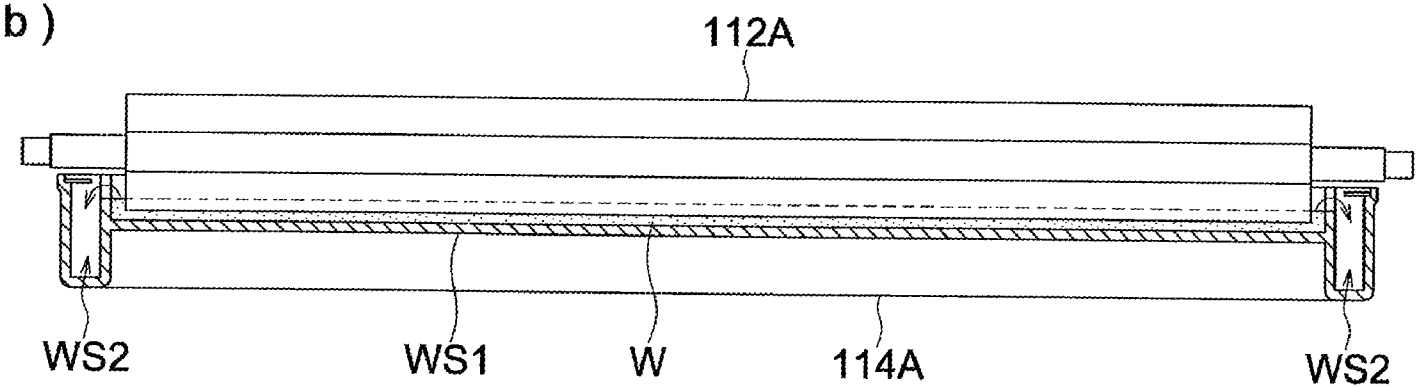
FIG. 7 ( b )

SHEET MOISTURIZING DEVICE, SHEET REMEDYING APPARATUS INCORPORATING THE SHEET MOISTURIZING DEVICE, AND IMAGE FORMING APPARATUS INCORPORATING THE SHEET MOISTURIZING DEVICE

This application is based on Japanese Patent Application No. 2006-279948 filed on Oct. 13, 2006 with the Japanese Patent Office, the entire content of which is hereby incorporated by reference.

FIELD OF THE INVENTION

The present invention relates to a sheet moisturizing device to moisture a sheet, a sheet remedying apparatus incorporating the same sheet moisturizing device, and an image forming apparatus incorporating the same sheet moisturizing device.

BACKGROUND OF THE INVENTION

In an image forming apparatus using an electro-photographic method, such as a copying machine, a printer, a facsimile, and a compound-machine having several of these functions, since moisture in the recording sheet is decreased during the heat fixing process, problems occur due to the sheet being curled or wavy. One way to counter these problems, is moisturizing the sheet after the fixing process.

Unexamined Japanese Patent Application Publication No. 2006-8282 discloses a sheet moisturizing apparatus including paired moisturizing rollers to nip and convey a sheet, a water supplying device which supplies water on the surface of at least one of the paired moisturizing rollers, and a restricting section which restricts water amount to be supplied to the surface of at least one of the paired moisturizing rollers.

U.S. Pat. No. 5,987,301 discloses a moisture control system of a recording sheet, in which the sheet, ejected from a fixing device, is horizontally conveyed, and is nipped by a paired moisturizing rollers to be ejected. The sheet moisturizing device in this system includes the paired moisturizing rollers, a compromising roller and a water supplying roller, each arranged either above and below the sheet conveyance path.

The sheet moisturizing device of each Patent Document has a single water tank in which the water supplying roller is partially submerged.

A wavy sheet, ejected from a heat fixing device, is moisturized by the sheet moisturizing device, whereby the wavy sheet is flattened. However, it is very difficult to completely seal the water supplying roller and the water tank in which the water supplying roller is partially submerged. Further, when the sheet remedying apparatus is displaced, or when the sheet moisturizing device is installed in or withdrawn from the sheet remedying apparatus, water stored in the tank is agitated and flows out through gaps between the water tank and the water supplying roller, whereby the sheet moisturizing device becomes wet, which results in malfunctioning of sheet conveyance, such as sheet jamming in various places of the sheet conveyance path.

SUMMARY OF THE INVENTION

Aspects of the present invention are detailed below.

Item 1. A sheet moisturizing device including: paired moisturizing rollers which form a nipping section to apply water onto a sheet when the sheet is conveyed through the nipping section, two water supplying rollers, each being in pressure contact to each of paired moisturizing rollers, respectively, and two water supplying tanks, each arranged to face one of the water supplying rollers, wherein each of said two water supplying tanks are structured of a first tank which supplies water to the water supplying roller, and a second tank which is formed around the first tank and stores water over-flowed from the first tank.

Item 2. An image forming apparatus, including: an image forming apparatus main body including: an image forming section to form an image on a sheet, and a fixing device to fix the sheet carrying the formed image, and the sheet moisturizing device described in Item 1.

Item 3. A sheet remedying apparatus, including: a sheet introduction section to receive a sheet, the sheet moisturizing device described in Item 1 which supplies water onto the sheet received by the sheet introduction section, and a sheet conveyance section which conveys the sheet to which the water has been supplied.

BRIEF DESCRIPTION OF THE DRAWINGS

FIG. 6 (*a*) is a frontal cross-sectional view of conventional sheet moisturizing device, while FIG. 6(*b*) is the same of the present invention.

FIG. 7 (*a*) is a cross-sectional side view of the sheet moisturizing device of the conventional art, while FIG. 7(*b*) is the same of the present invention.

DETAILED DESCRIPTION OF THE INVENTION

The present invention will be detailed referring to embodiment, however, the present invention is not limited to said embodiment.

Figure 1:
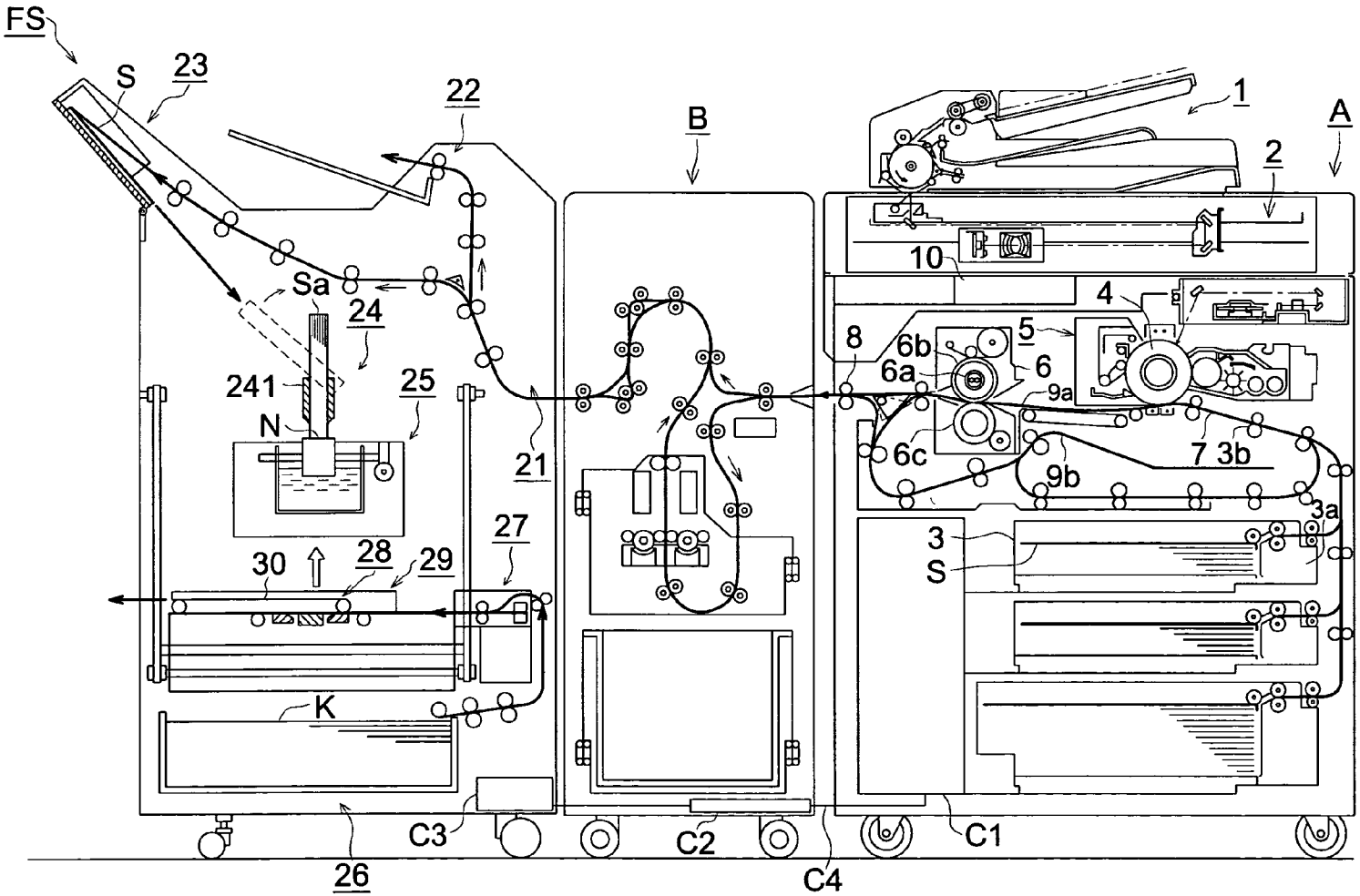
FIG. 1 shows a total view of an image forming apparatus relating to embodiment of the present invention.

FIG. 1 shows a total view of an image forming apparatus relating to the embodiment of the present invention, wherein the image forming apparatus is structured of image forming apparatus main body A, sheet remedying apparatus B, and sheet post-finishing device FS.

[Image Forming Apparatus Main Body]

Image forming apparatus main body A has automatic document feeding device 1 and image reading section 2 at the upper position, while the lower position is structured of a printer section.

In the printer section, numeral 3 represents a blank sheet storing section to store sheets S. Numeral 5 represents the image forming section (being a printer engine) which conducts electrostatic charging and exposure onto photoconductor 4 to form a latent toner image on photoconductor 4 via an electro-photographic process, whereby an image is formed on sheet S, and the formed image is fixed by fixing device 6. Fixing device 6 forms a sheet nipping section in which sheet S is nipped by heated roller 6*b* housing heat source 6*a* and pressure applying roller 6*c*, whereby the sheet nipping section conveys sheet S under heat and pressure so that toner is melted and fixed to become a permanent image on sheet S.

Sheet S is conveyed from sheet storing section 3 by first sheet-supplying section 3*a*, and after sheet S is temporarily stopped at second sheet-supplying section 3*b*, sheet S is further conveyed for image formation, after which sheet S carrying the formed image is ejected from a sheet ejecting section by paired sheet ejecting rollers 8.

Concerning conveyance paths for sheet S, provided are sheet conveyance path 7 which is from sheet storing section 3 to image forming section 5, conveyance path 9*a* which is from image forming section 5 to the sheet ejecting section passing through fixing device 6 and paired sheet ejecting rollers 8, and reversing conveyance path 9*b* which reverses and conveys sheet S for double-sided printing.

Concerning image forming modes, provided are: 1) a mode to eject a sheet on which an image carrying surface faces downward, 2) a mode to eject a sheet on which an image carrying surface faces upward, and 3) a mode to eject a sheet on which both surfaces carry an image. In mode 1) in which a sheet is ejected while its image carrying surface faces downward, such sheet S passes through fixing device 6, after which sheet S is reversed, and ejected by paired sheet ejecting rollers 8.

In mode 2) in which a sheet is ejected while its image carrying surface faces upward, such sheet S is conveyed through conveyance path 9*a*, after which sheet S is ejected by paired sheet ejecting rollers 8, without any additional operation.

In mode 3) in which a sheet is ejected while both surfaces carry an image, after initial image formation is conducted on a single surface, sheet S passes through fixing device 6, and is conveyed downward to enter reversing conveyance path 9*b*, where sheet S is reversed and then returned to sheet supplying path 7.

On returned sheet S, image formation is conducted on a reverse surface by image forming section 5, after which sheet S carrying an image on both surfaces passes through fixing device 6, and is ejected by paired ejecting rollers 8.

Numeral 10 represents an operation section, by which the operator can set the various modes concerning image forming apparatus main body A, and various output modes using sheet post-finishing device FS.

Control section C1, arranged in image forming apparatus main body A, is connected to control section C2 of sheet remedying apparatus B, and control section C3 of sheet post-finishing device FS, through communication section C4.

Sheet S, ejected from image forming apparatus main body A, is conveyed to sheet post-finishing device F through sheet remedying apparatus B.

After curled sheets S are flattened by after described sheet moisturizing device 110 and de-curling sections 130 and 131, of sheet remedying apparatus B, they are formed as a booklet by sheet post-finishing device FS, which will be detailed later. Sheet remedying apparatus B and sheet post-finishing device FS will be detailed below.

Sheet post-finishing device FS conducts various processes on sheet S ejected from image forming apparatus main body A, and is a general name of a combined punching-folding machine, a side-stitching machine machine, a saddle-stitching machine, an adhesive-bookmaking machine and a cutting machine.

As an example of sheet post-finishing device FS, the adhesive pasting-bookmaking machine will now be detailed.

The adhesive pasting-bookmaking machine includes sheet introduction section 21, sheet ejecting section 22, stacking sheet storing section 23, stacked sheet conveyance section 24, adhesive pasting section 25, cover supplying section, 26, cover cutting section 27, cover attaching section 28 (in which stacked sheets are wrapped by a single cover sheet including a front cover and a back cover), and arranging section 29 which determines the position of a cover sheet.

Sheets S, introduced into sheet introduction section 21, are conveyed to stacking sheets storing section 23, then each sheet S is slantingly conveyed downward one by one, where sheets S are stacked to become stacked sheets Sa, which are held by holding section 241 of stacked sheet conveyance section 24. Stacked sheets Sa are then rotated to a predetermined position, where a book spine faces downward, on which an adhesive is pasted (which is adhesive pasting surface N) by adhesive pasting section 25.

Cover sheet K, stored in cover sheet supplying section 26, is conveyed to cover sheet packing section 28 through cover sheet cutting section 27, where the trailing edge of cover sheet K is cut to be a predetermined length by cover sheet cutting section 27. The length of cover sheet K, which is cut to be the predetermined length, is the sum total of two sheets lengths in a conveyance direction of sheet S and the thickness of stacked sheets Sa.

Cover sheet packing section 28 receives cover sheet K from cover sheet supplying section 26, and temporarily stops it at a predetermined position, where alignment section 29 determines a position of a width direction of cover sheet K. Cover sheet packing section 28 presses cover sheet K against adhesive coated surface N, whereby cover sheet K is adhered to stacked sheets Sa.

Cover sheet K is then folded at the edges of the spine by a pressing member which faces the spine and moves downward, and paired folding members which are symmetrically arranged above cover sheet packing section 28, whereby stacked sheets Sa covered by cover sheet K is formed.

After cover sheet K has been folded, cover sheet packing section 28 is retracted downward, then ejection belt 30, which has been retracted outside the width direction of cover sheet K while alignment section 29 has been retracted, moves toward the inside of the width direction under stacked sheets Sa, and then stops. After stacked sheets Sa are released from holding section 241, stacked sheets Sa are lowered and stop when the spine of stacked sheets Sa touches the upper surface of ejection belt 30. Rotating ejection belt 30 ejects stacked sheets Sa, covered with cover sheet K, to the exterior of sheet post-finishing device FS.

[Sheet Remedying Apparatus]

Figure 2:
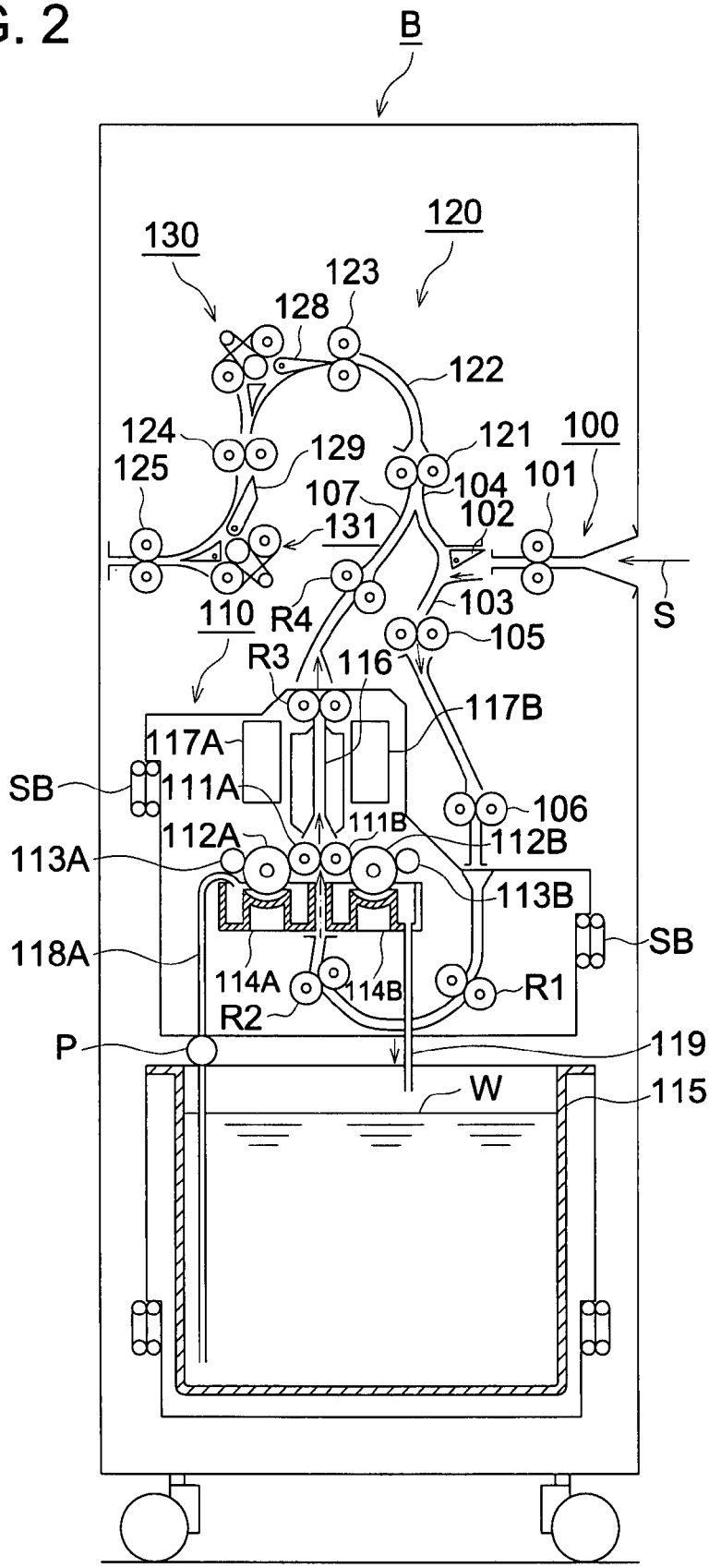
FIG. 2 is a cross-sectional view of a sheet remedying apparatus carrying a sheet moisturizing device in the embodiment of the present invention.

FIG. 2 is a cross-sectional view of a sheet remedying apparatus carrying sheet moisturizing device 110 in the embodiment of the present invention.

Sheet remedying apparatus B is structured of sheet introduction section 100, sheet moisturizing device 110, sheet conveyance section 120 and sheet decurling sections 130 and 131.

Sheet S, on which images were formed by the image forming section of image forming apparatus main body A, is ejected from main body A through fixing device 6 and paired sheet ejection rollers 8, and enters sheet introduction section 100 of sheet remedying apparatus B, where sheet S is nipped by paired conveyance rollers 101 to be further conveyed.

Switching gate 102, mounted more downstream in the sheet conveyance direction than paired conveyance rollers 101, switches so that sheet S is conveyed downward to sheet moisturizing path 103, or upwardly conveyed into by-pass 104.

Sheet S, which is switched to be conveyed to sheet moisturizing path 103, is conveyed to sheet moisturizing device 110 through paired conveyance rollers 105 and paired conveyance rollers 106.

Sheet S, introduced into sheet moisturizing device 110, is U-turned by paired conveyance rollers R1 and paired conveyance rollers R2, after which sheet S is moisturized by paired moisturizing rollers 111A and 111B, both rotate pressing against each other. Then sheet S is conveyed through conveyance path 116, and nipped by paired conveyance rollers R3 and paired conveyance rollers R4 to be passed trough conveyance path 107, after which sheet S is conveyed toward paired conveyance rollers 121 of sheet conveyance section 120.

Sheet moisturizing device 110 includes water supplying rollers 112A and 112B, regulation rollers 113A and 113B, and water supplying tanks 114A and 114B. Numeral 116 represents a conveyance path, and numerals 117A and 117B represent an air fan.

Figure 3:
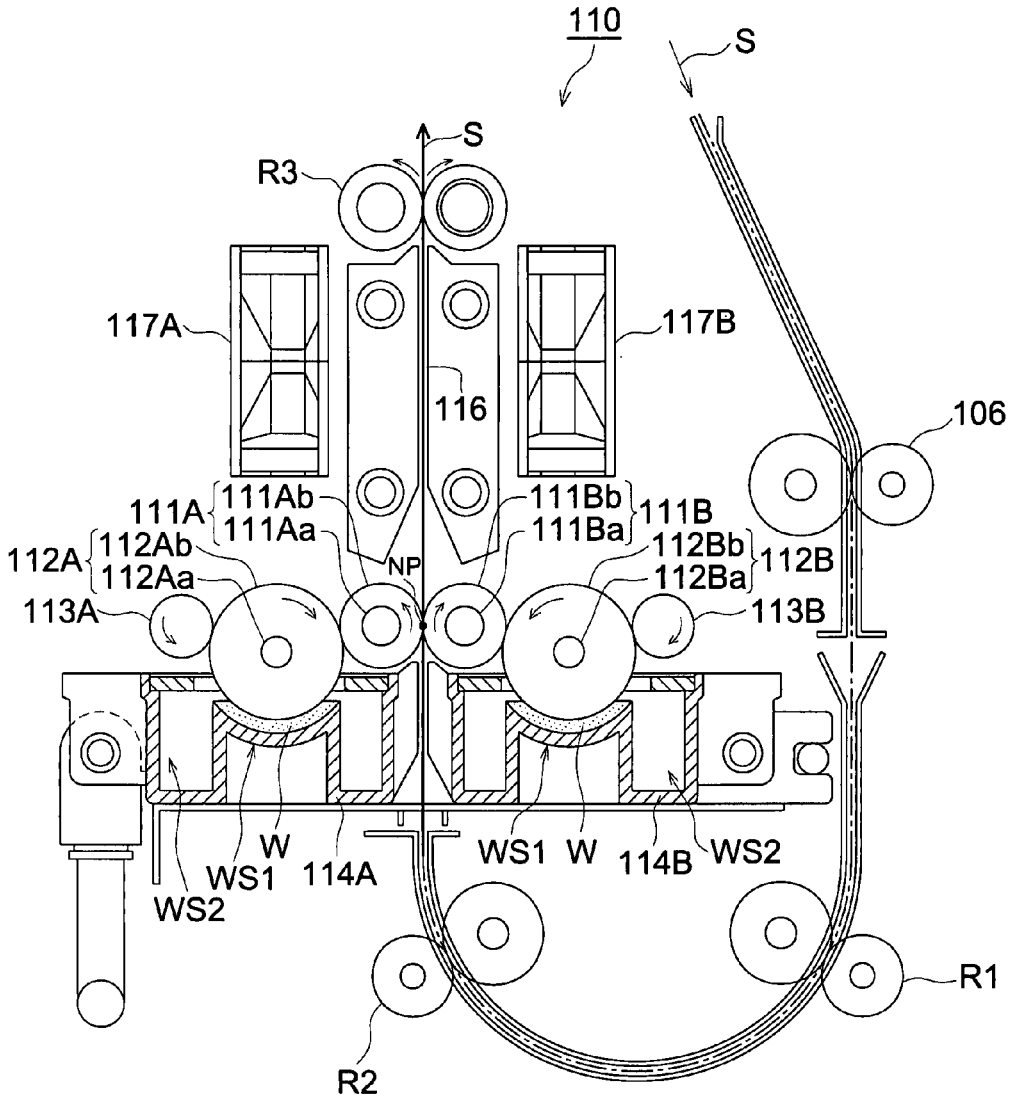
FIG. 3 is a cross-sectional view of the sheet moisturizing device.

Sheet moisturizing device 110 will now be further detailed while referring to FIG. 3.

In FIG. 2, paired conveyance rollers 121 receive sheet S which is from by-pass 104, and sheet S which is ejected from sheet moisturizing device 110 and conveyed through conveyance path 107. Sheet S, conveyed by paired conveyance rollers 121, is conveyed through conveyance path 122, and is ejected by paired sheet ejection rollers 125 to exterior sheet remedying apparatus B, through paired conveyance rollers 123, and paired conveyance rollers 124.

On sheet conveyance section 120, decurling sections 130 and 131 are arranged to remedy a curled sheet. Decurling sections 130 and 131 are structured of plural groups of rollers, between which the curled sheet is conveyed to be remedied.

After sheet S is conveyed by paired conveyance rollers 123, it is decurled by decurling section 130 after its conveyance path is switched by switching gate 128, and is decurled by decurling section 131 after its conveyance path is switched by switching gate 129.

Sheets S introduced to sheet moisturizing device 110, includes various types, thickness, and water content. There are some cases in which sheet S will be curled, though it has been moisturized by sheet moisturizing device 110. Additionally, it may be waved in some cases. Accordingly, if it is determined that there is possibility for sheet S to be curled or waved, switching gate 128 or 129 is driven by unillustrated solenoid, and curled or waved sheet S is conveyed to a curved conveyance path of decurling section 130 or 131.

If it is determined that there is no possibility for sheet S to be curled or waved, sheet S is conveyed through switching gates 128 and 129, both being set in their initial position, whereby the processing time is decreased.

Switching gates 128 and 129 are preferably controlled based on the sheet type set by operation section 10, or based on signals outputted from environmental sensors for temperature or humidity.

Further, if moisturizing operation is not to be conducted by sheet moisturizing device 110, moisturizing rollers 111A and 111B forming nipping section NP, are separated from each other so that they are prevented from being deformed by contact pressure.

Sheet moisturizing device 110 is supported by sliding bearings SB, located on the left and right sides as shown in FIG. 2, so that it can be readily inserted in or removed from sheet remedying apparatus B.

[Sheet Moisturizing Device]

FIG. 3 is a cross-sectional view of sheet moisturizing device 110.

Numerals 111A and 111B represent paired rollers which apply water to sheet S to moisturize it. Both include shafts 111Aa and 111Ba, respectively. Porous layers 111Ab and 111Bb, being of porous polyurethane rubber, are formed on shafts 111Aa and 111Ba, respectively.

Porous layers 111Ab and 111Bb receive water on their surfaces, and subsequently apply water to sheet S.

Numeral 112A represents a water supplying roller which is in contact with moisturizing roller 111A to supply water W. Water supplying roller 112A includes metallic or hard resin shaft 112Aa, on which porous layer 112Ab, being porous polyurethane rubber, are formed.

Water supplying roller 112B is similarly formed of shaft 112Ba and porous layer 112Bb, to serve the same function as water supplying roller 112A.

When sheet moisturizing device 110 is activated, in order to quickly supply water W to moisturizing rollers 111A and 111B, water supplying rollers 112A and 112B preferably include porous layers 112Ab and 112Bb. However, the porous layers are not always necessary, but hydrophilic materials, such as metal, hydrophilized resin, or solid rubber, may also be used for the surfaces of water supplying rollers 112A and 112B.

Numerals 113A and 113B represent rigid regulation rollers, formed of metal or hard resin. Regulation roller 113A is in pressure-contact with water supplying roller 112A, while regulation roller 113B is in pressure-contact with water supplying roller 112B. Regulation roller 113A squeegees water in porous layer 112Ab, while regulation roller 113B squeegees water in porous layer 112Bb, so that the water amount to be applied sheet S is controlled. That is, regulation rollers 113A and 113B come into pressure-contact with porous layers 112Ab and 112Bb of moisturizing rollers 111A and 111B respectively. Porous layers 112Ab and 112Bb are deformed by regulation rollers 113A and 113B respectively, and water in porous layers 112Ab and 112Bb is squeezed. Due to this, the amount of water being applied to sheet S is controlled, whereby sheet S is appropriately moisturized, and excessive moisturizing is regulated. In addition, the contacting pressure of regulation rollers 113A and 113B against water supplying rollers 112A and 112B is controlled respectively so that appropriate moisturizing can be achieved.

While being conveyed by moisturizing rollers 111A and 111B, sheet S is moisturized at nipping section NP by the water squeezed out from porous layers 111Ab and 111Bb. The amount of water to be applied to sheet S is appropriately controlled by regulation rollers 113A and 113B. The contacting pressures of regulation rollers 113A and 113B against water supplying rollers 112A and 112B can be appropriately set. That is, based on the settings of the sheet type inputted on operation section 10 of image forming apparatus main body A, or based on signals outputted from environmental sensors for temperature and humidity, the control section preferably sets the line speed of water supplying rollers 112A and 112B, and their contact pressure.

Further, it is possible to provide a structure in which a non-moisturizing mode is established, while no nipping section NP is formed between moisturizing rollers 111A and 111B.

Water supplying roller 112A is partially submerged in water W stored in water supplying tank 114A, while water supplying roller 112B does the same in water W stored in water supplying tank 114B.

As shown in FIG. 2, water supplying tanks 114A and 114B are connected to water storing tank 115, which is located under water supplying tanks 114A and 114B, via water supplying tube 118A and water supplying pump P, whereby water W stored in water storing tank 115 can be sent to water supplying tanks 114A and 114B.

Air fans 117A and 117B, which are located on both sides of conveyance path 116, blow air onto both surfaces of sheet S, which was moisturized by moisturizing rollers 111A and 111B, whereby any residual water W on both surfaces of sheet S is dried, and sheet S is maintained at an appropriate moisture content. Due to this structure, various conveyance means, such as conveyance rollers and guide plates, are prevented from being wetted by the water used to moisture the surfaces of sheet S. Further, since adhesion of sheet S due to excess water does not occur so that sheet jamming, malfunctions of various sections of sheet moisturizing device 110, or short duration of the device are prevented.

[Driving Section of Sheet Moisturizing Device]

Figure 4:
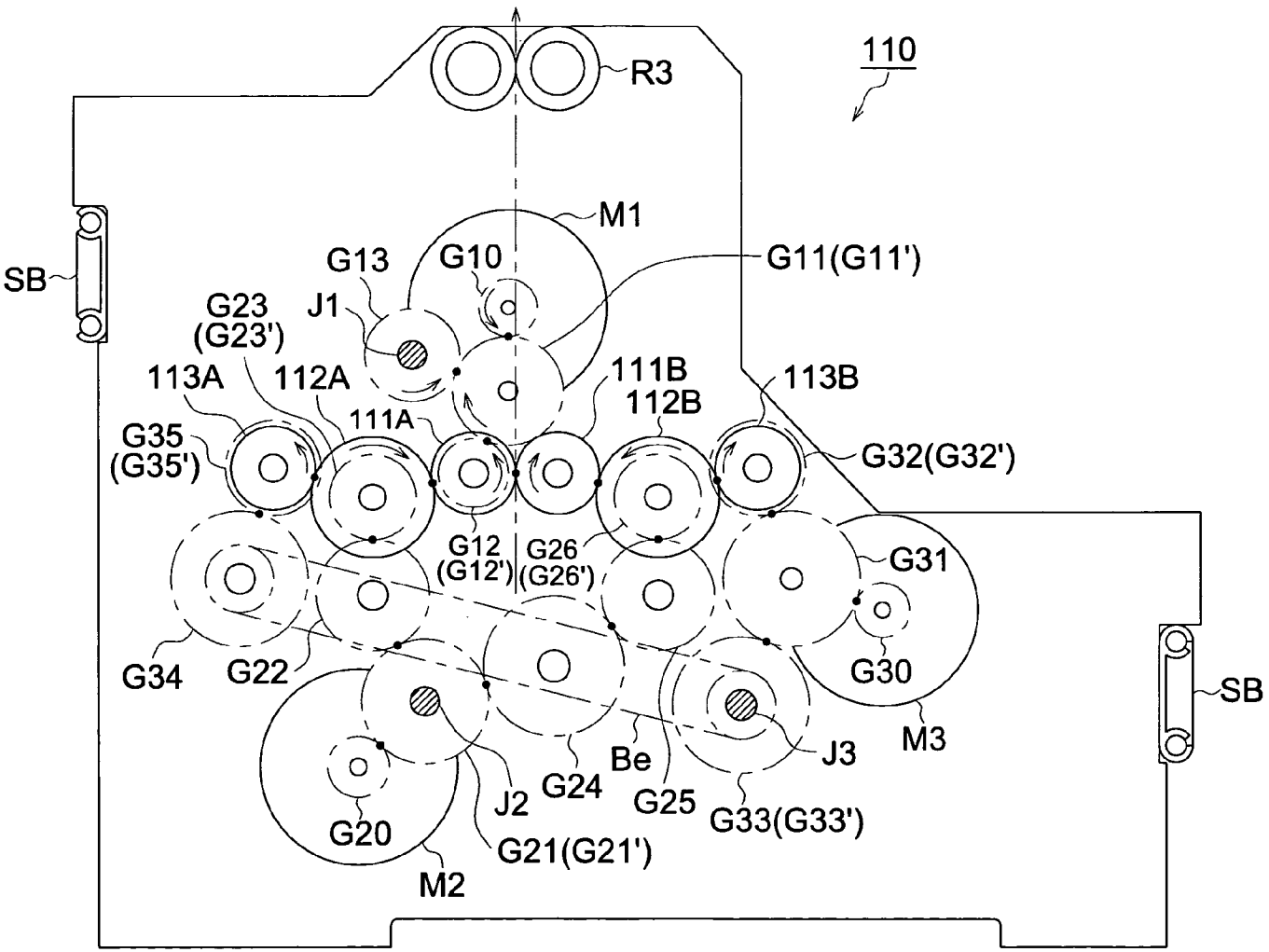
FIG. 4 is a front view of a driving section of the sheet moisturizing device.

FIG. 4 is a front view of a driving section of sheet moisturizing device 110.

A first driving section, incorporating motor M1 as its driving source, rotates gear G12 which is fixed on an end of moisturizing roller 111A, via gear G10 and intermediate gear G11. Since intermediate gears G11 and G11' are symmetrically fixed to each other on both sides of penetrating shaft J1 carrying gear 13. Accordingly, Gear G11 rotates intermediate roller G13, and intermediate roller G11' by intermediate roller G13', further rotates gear G12' which is symmetrically mounted on another end of moisturizing roller 111A, to gear G12. That is, motor M1 drives moisturizing roller 111A via the above detailed gear trains.

A second driving section, incorporating motor M2 as its driving source, rotates gear G23 which is fixed at one end of water supplying roller 112A, via gear G20 and intermediate gears G21 and G22. Further, intermediate gear G21 rotates gear G26 which is fixed at one end of water supplying roller 112B, via intermediate gears G24 and G25. Gear G21 and gear G21' are symmetrically fixed to each other at both ends of shaft J2. Gear G23 and gear G23' are also symmetrically fixed to each other at both ends of water supplying roller 112A. Gear G26 and gear G26' are symmetrically fixed to each other at both ends of water supplying roller 112B. Accordingly intermediate gear G21 rotates intermediate gear G 21', gear G23', and gear G26'. That is, motor M2 drives water supplying rollers 112A and 112B, via the above detailed gear trains.

A third driving section, incorporating motor M3 as its driving source, rotates gear G32 which is fixed on one end of regulation roller 113B, via gear G30 and intermediate gear G31. Further, intermediate gear G31 rotates intermediate gear G33, and gear G35 which is fixed on one end of regulation roller 113A, via belt Be and intermediate gears G34. Intermediate gears G33 and G33' are symmetrically fixed to each other at both ends of shaft J3. Gears G35 and G35' are symmetrically fixed to each other at both ends of regulation roller 113A. Gears G32 and G32' as well are symmetrically fixed to each other at both ends of regulation roller 113B. Accordingly, intermediate gear G33 rotates intermediate gear G33', gear G35', and gear G32'. That is, motor M3 drives regulation rollers 113A and 113B, via the above detailed gear trains.

Figure 5:
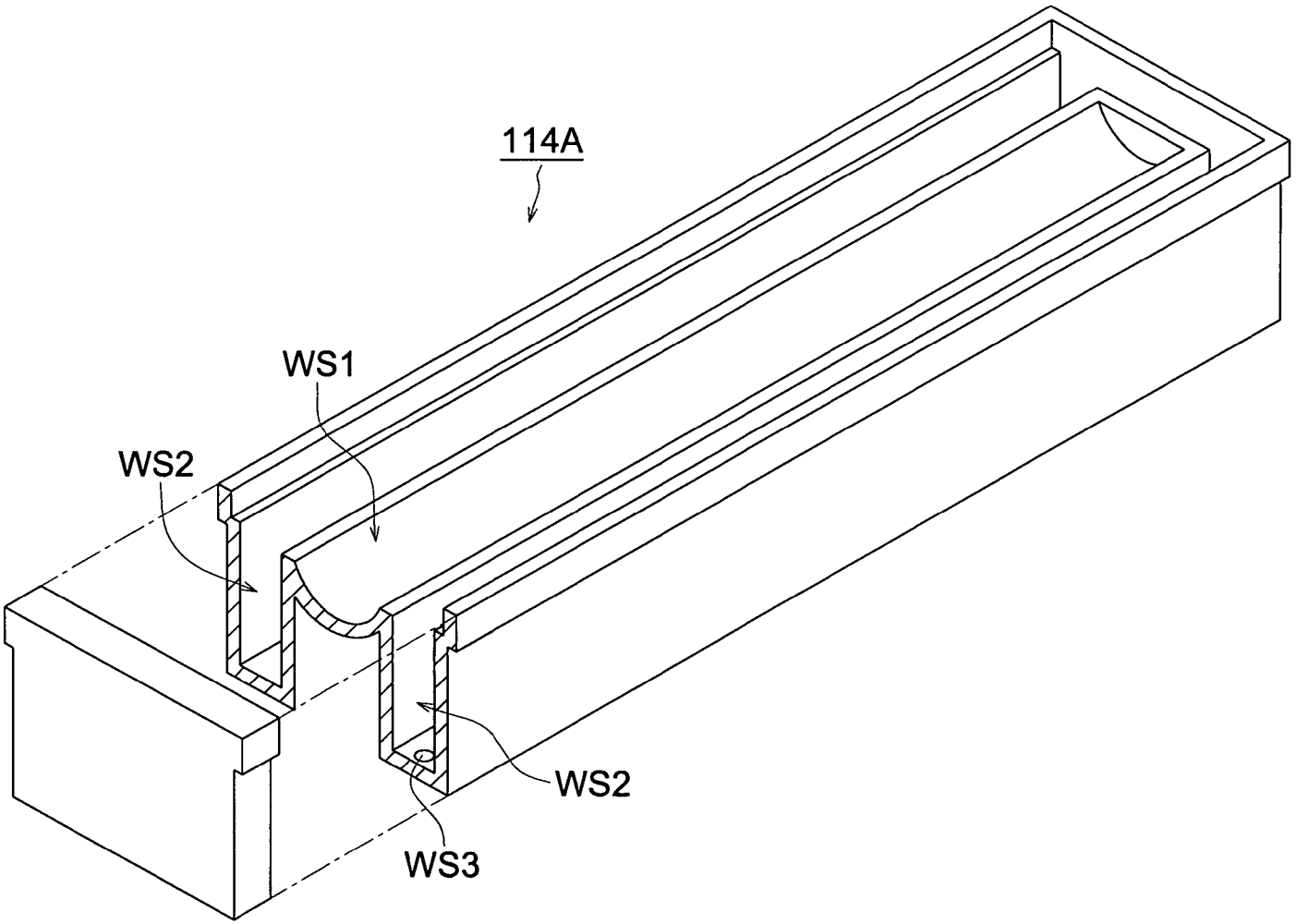
FIG. 5 is a perspective view of a water supplying tank which is partially broken away.

FIG. 5 is a partially broken away perspective view of water supplying tank 114A. Since water supplying tanks 114A and 114B are formed to the same shape, only water supplying tank 114A will be detailed.

Water supplying tank 114A is formed as a double wall structure, incorporating first tank WS1, being an interior tank, and second tank WS2, being on both sides of first tank WS1. First tank WS1 is a part-cylindrical wall to store water, separated from the peripheral surface of water supplying roller 112A at a predetermined clearance. Water W is pumped by pump P to be supplied from water storing tank 115 to first tank WS1, via water supplying tube 118A, see FIG. 2.

Figure 8:
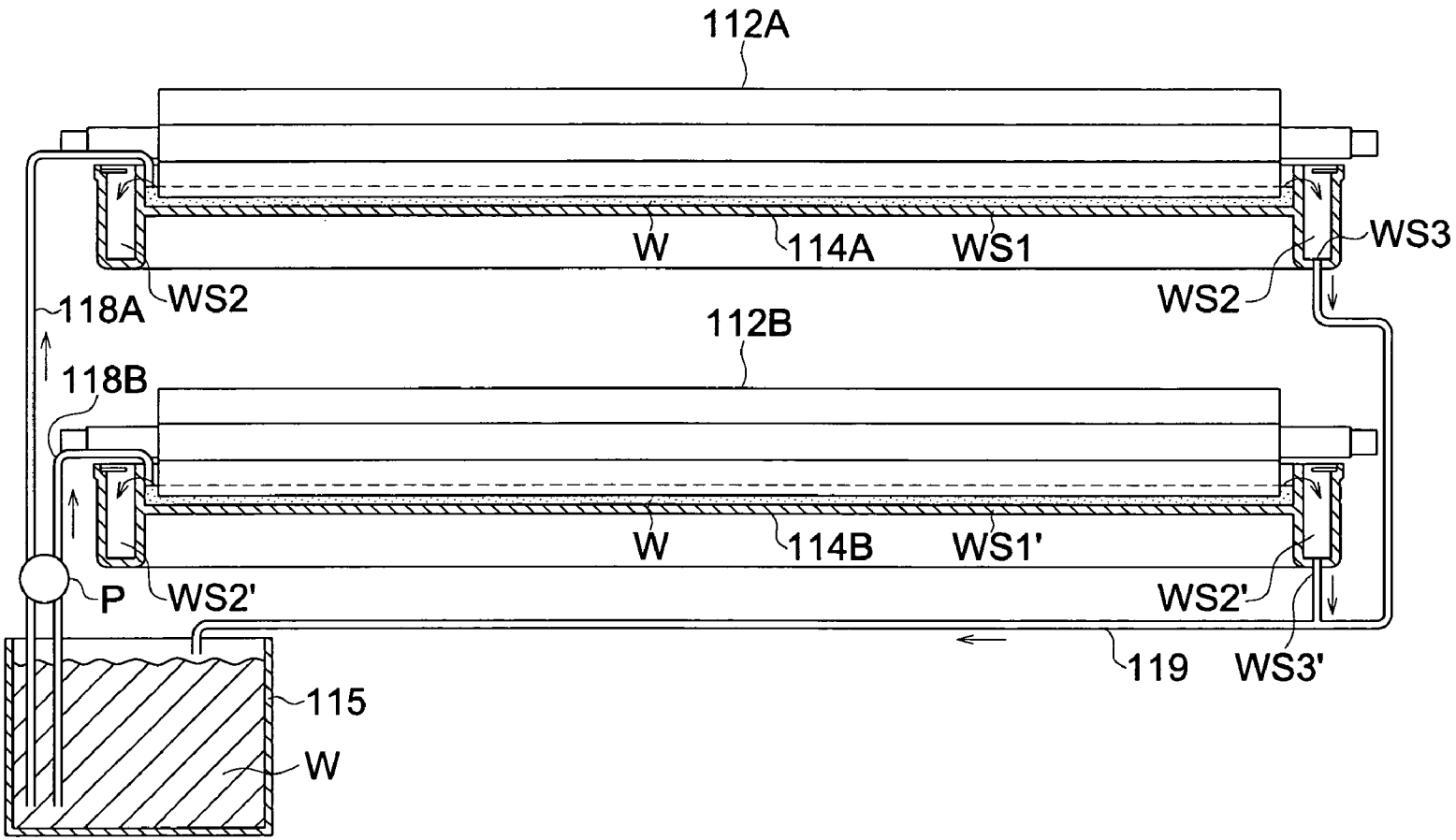
FIG. 8 is a cross-sectional view showing water supply and discharge system of the sheet moisturizing device.

Second tank WS2 receives water W overflowing from the longitudinal edges of first tank WS1. The bottom of second tank WS2 is sloped toward drain WS3 so that water W in second tank WS2 can drain away. Water W drained through drain WS3 is returned to water storing tank 115 through drain tube 119, as shown in FIG. 8.

FIG. 6 (*a*) is a cross-sectional front view of a sheet moisturizing device of a prior art, while FIG. 7 (*a*) is a cross-sectional side view of the sheet moisturizing device of the prior art.

Concerning a water supplying tank having a single tank as detailed in Unexamined Japanese Patent Application Publication No. 2006-8282, a large volume of water W, for example 520 ml, is stored in water supplying tank 114, in which water supplying roller 112A is partially submerged. When sheet moisturizing device 110 is relocated, the water surface of water W in water supplying tank 114 becomes wavy so that water W tends to spill between water supplying tank 114 and water supplying roller 112A, as shown by arrows in FIG. 6(*a*), whereby sheet moisturizing device 110 is flooded.

Further, the large volume of water W stored in water supplying tank 114 stays for a long time so that sediment may settle to the bottom of water supplying tank 114.

FIG. 6(*b*) is a front cross-sectional view of sheet moisturizing device 110 of the present invention, while FIG. 7(*b*) is a cross-sectional side view of sheet moisturizing device 110 of the present invention.

In FIG. 6(*b*), first tank WS1 of water supplying tank 114A accommodates barely enough water W, for example 23 ml, in which water supplying roller 112A is partially submerged and whose peripheral surface is separated from the inner cylindrical wall of tank 114A at a predetermined clearance. The amount of water W in first tank WS1 is so low that water vibration is very small. Further, it is possible to continuously supply fresh water into first tank WS1.

Still further, the inner surface of first tank WS1 is concentric to the periphery of water supplying roller 112A, between which a water supplying path is formed as a uniform clearance. Accordingly, water W, supplied from water storing tank 115 through pump P, overflows to second tank WS2 from the water supplying path having the uniform clearance, without becoming stagnant.

Still further, since width L1 at the water surface of first tank WS1 is less than diameter L2 of water supplying roller 112A, water supplying roller 112A also functions as a cover for first tank WS1, whereby water W is restricted as it flows from the edge of first tank WS1. Accordingly, when sheet moisturizing device 110 is relocated, any vibration of the water surface of water W becomes small, and little water W flows over from the clearance between water supplying roller 112A and water supplying tank 114A. Additionally, the flown out water from first tank WS1 enters second tank WS2 and is drained away to water storing tank 115 through drain tube 119.

FIG. 8 is a cross-sectional view showing water supply and water discharge of the sheet moisturizing device.

Water W, stored in water storing tank 115, is pumped by pump P, conveyed through tubes 118A and 118B, to first tank WS1 of water supplying tank 114A, and also to first tank WS1' of water supplying tank 114B, whereby said water W moisturizes water supplying rollers 112A and 112B.

Water W, circulated in first tank WS1, flows out to second tank WS2, from which it then returns to water storing tank 115 from drain WS3 through tube 119.

Water W, circulated in first tank WS1', flows out to second tank WS2', from which it then returns to water storing tank 115 from drain WS3' through tube 119.

In the embodiment of the present invention, the image forming apparatus was detailed which was connected to the sheet remedying apparatus, including the sheet moisturizing device. However, the present invention can be utilized onto an image forming apparatuses, wherein image forming apparatus main bodies, such as a near-printer, a printer, a facsimile, and a digital compound device, are connected to the sheet remedying apparatus, including the above sheet moisturizing device.

The water supplying tank of the sheet moisturizing device of the present embodiment has the doubled structured first and second tanks, whereby water overflowing from the first tank is caught by the second tank so that the sheet moisturizing device remains dry.

Further, since only barely enough water is stored in the first tank, the water supplying efficiency can be improved.

Still further, when the sheet remedying apparatus is relocated, or when the sheet moisturizing device is inserted into or removed from the sheet remedying apparatus, water in the tank in which the sheet supplying roller is partially submerged, is prevented from splashing from the clearance between the tank and the water supplying roller so that the sheet moisturizing device and environs remain dry.

In the image forming apparatus, connected to the image forming apparatus main body, and the sheet moisturizing device, the sheet, ejected from the heat-fixing device in the image forming apparatus main body, can be decurled or dewaved by the sheet moisturizing device, so that a fully flat sheet carrying the printed images is sent out.

What is claimed is:

1. A sheet moisturizing device, comprising:

paired moisturizing rollers which form a nipping section to apply water onto a sheet when the sheet is conveyed vertically from a bottom of the nipping section up through the nipping section;

two water supplying rollers, each being in pressure contact with a respective one of the paired moisturizing rollers to supply the water thereto; and two water supplying tanks, each arranged to face a respective one of the two water supplying rollers;

wherein each of the two water supplying tanks includes a first tank which supplies the water to one of the two water supplying rollers, and a second tank which is formed around the first tank and stores water overflowed from the first tank, wherein a diameter of each of the water supplying rollers is greater than a width of a water surface of the first tank so as to cover the first tank, and wherein an outer wall of the second tank is higher than a wall of the first tank.

2. The sheet moisturizing device of claim 1, further comprising a water storing tank to supply the water to be supplied to the two water supplying tanks.

3. The sheet moisturizing device of claim 2, further comprising a water circulating path including a water supplying section to supply the water to each of the first tanks, and a water ejecting section to eject the over-flowed water to the water storing tank.

4. The sheet moisturizing device of claim 1, wherein the wall of the first tank is a concaved inner wall to store the water.

5. The sheet moisturizing device of claim 4, wherein the concaved inner wall is concentric to a periphery of the water supplying roller corresponding thereto.

6. An image forming apparatus, comprising:

an image forming apparatus main body including an image forming section to form an image on a sheet, and a fixing device to fix the sheet carrying the formed image; and a sheet moisturizing device including:

paired moisturizing rollers which form a nipping section to apply water onto a sheet when the sheet is conveyed vertically from a bottom of the nipping section up through the nipping section;

two water supplying rollers, each being in pressure contact with a respective one of the paired moisturizing rollers to supply the water thereto; and two water supplying tanks, each arranged to face a respective one of the two water supplying rollers;

wherein each of the two water supplying tanks includes a first tank which supplies the water to one of the two water supplying rollers, and a second tank which is formed around the first tank and stores water overflowed from the first tank, wherein a diameter of each of the water supplying rollers is greater than a width of a water surface of the first tank so as to cover the first tank, and wherein an outer wall of the second tank is higher than a wall of the first tank.

7. A sheet remedying apparatus, comprising:

a sheet introduction section to receive a sheet, a sheet moisturizing device which supplies the water onto the sheet received by the sheet introduction section, and a sheet conveyance section which conveys the sheet to which the water has been supplied, wherein the sheet moisturizing device includes:

paired moisturizing rollers which form a nipping section to apply water onto a sheet when the sheet is conveyed vertically from a bottom of the nipping section up through the nipping section;

two water supplying rollers, each being in pressure contact with a respective one of the paired moisturizing rollers to supply the water thereto; and two water supplying tanks, each arranged to face a respective one of the two water supplying rollers;

wherein each of the two water supplying tanks includes a first tank which supplies the water to one of the two water supplying rollers, and a second tank which is formed around the first tank and stores water overflowed from the first tank, wherein a diameter of each of the water supplying rollers is greater than a width of a water surface of the first tank so as to cover the first tank, and wherein an outer wall of the second tank is higher than a wall of the first tank.

* * * * *